US009110425B2

(12) United States Patent
Watanabe et al.

(10) Patent No.: US 9,110,425 B2
(45) Date of Patent: Aug. 18, 2015

(54) SHEET BINDING DEVICE AND IMAGE FORMING APPARATUS INCORPORATING SAME

(75) Inventors: Tetsuo Watanabe, Kanagawa (JP); Koichi Kudo, Kanagawa (JP); Yoshinobu Takeyama, Kanagawa (JP); Takashi Hashimoto, Kanagawa (JP); Fumihito Masubuchi, Kanagawa (JP); Natsumi Matsue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 297 days.

(21) Appl. No.: 13/570,838

(22) Filed: Aug. 9, 2012

(65) Prior Publication Data

US 2013/0051886 A1 Feb. 28, 2013

(30) Foreign Application Priority Data

Aug. 24, 2011 (JP) ..... 2011-183009

(51) Int. Cl.
*G03G 15/00* (2006.01)
*B65H 37/04* (2006.01)

(52) U.S. Cl.
CPC ..... *G03G 15/6544* (2013.01); *B65H 37/04* (2013.01); *G03G 15/50* (2013.01); *B65H 2301/43822* (2013.01); *B65H 2301/43827* (2013.01); *G03G 15/6541* (2013.01); *G03G 2215/00835* (2013.01)

(58) Field of Classification Search
CPC .... B42C 1/12; B42C 9/0081; G03G 15/6544; G03G 15/6541; G03G 2215/00835
USPC ..... 399/408, 409, 67–69, 122, 320; 412/20, 412/22, 37, 18
See application file for complete search history.

(56) References Cited

U.S. PATENT DOCUMENTS

| | | | | | |
|---|---|---|---|---|---|
| 5,456,646 | A * | 10/1995 | Crowley | 493/187 |
| 5,531,429 | A * | 7/1996 | Clark | 270/58.11 |
| 5,582,570 | A * | 12/1996 | Crowley | 493/187 |
| 6,473,539 | B1 * | 10/2002 | Koga | 382/317 |
| 6,712,924 | B2 * | 3/2004 | Silverbrook | 156/277 |
| 7,260,354 | B2 * | 8/2007 | Ishida | 399/409 |
| 2009/0035002 | A1 * | 2/2009 | Kushida et al. | 399/53 |

FOREIGN PATENT DOCUMENTS

| | | | |
|---|---|---|---|
| JP | 03-55269 | U | 5/1991 |
| JP | 07-223387 | A | 8/1995 |
| JP | 2000-255881 | A | 9/2000 |
| JP | 2007-121488 | A | 5/2007 |
| JP | 2010-165011 | A | 7/2010 |

* cited by examiner

*Primary Examiner* — Daniel J Colilla
*Assistant Examiner* — John M Royston
(74) *Attorney, Agent, or Firm* — Harness, Dickey & Pierce, P.L.C.

(57) ABSTRACT

An image forming apparatus includes an image forming unit to form an adhesive toner pattern in a predetermined bonding range of a sheet, outside a printable range in which an image according to image data is formed, a stacking unit to stack multiple sheets one on top of another, and a sheet binding device that includes a fusing device to fuse and fix the adhesive toner pattern formed on the multiple sheets to bind the multiple sheets together, and a bonding strength setting unit to determine, in accordance with a desired bonding strength, at least one of a number of color toners used for forming the adhesive toner pattern, a bonding manner, a number of pixels of the adhesive toner pattern, a toner area ratio of the adhesive toner pattern, and a layer thickness of the adhesive toner pattern.

15 Claims, 5 Drawing Sheets

SHEET BINDING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-183009, filed on Aug. 24, 2011, in the Japan Patent Office, the entire disclosure of which is hereby incorporated by reference herein.

FIELD OF THE INVENTION

The present invention generally relates to a sheet binding device and an image forming apparatus, such as a copier, a printer, a facsimile machine, or a multifunction machine having at least two of these capabilities, and, more particularly, to a sheet binding device that bonds together multiple sheets using toner used in electrophotographic image formation and an image forming apparatus that includes the sheet binding device.

BACKGROUND OF THE INVENTION

Sheet binding methods using toner as glue or adhesive for bonding together multiple sheets of recording media are known. For example, in JP-H07-223387-A, toner is softened with heat and is used as adhesive for binding documents, thereby obviating the need for disposable binding elements, such as staples or clips that are discarded when the documents bound thereby are discarded. Specifically, adhesive toner is applied to a binding margin of a sheet, and a binding margin of another sheet is superposed thereon. Then, the binding margins of the sheets are heated and pressed, thereby binding together the sheets.

JP-2000-255881-A also proposes a sheet binding device using adhesive toner to attain high-quality sheet binding in reduced processing time and to obviate the need for adjusting fixing conditions such as heating time or pressing time in accordance with changes in binding-related variables such as the number of sheets to be bound together. Specifically, in JP-2000-255881-A, in addition to a fixing device for fixing images according to image data, another fixing member is provided to fix adhesive toner applied to the binding margin each time the sheet is superimposed on the sheet stacked on a discharge tray, thereby binding together the sheets.

Additionally, in binding multiple sheets together, it is preferable that binding strength, that is, the strength of bonding by toner adhesion, is adjustable in accordance with increases in the number or thickness of sheets bound together.

In the case of metal staples, although binding strength may be adjusted with the size, strength, or hardness of the metal staple in accordance with the number of stacked sheets, large or hard staples cannot be removed from sheets easily. It is possible that sheets are damaged when the staples are being removed thereof.

Additionally, in binding sheets with staples, it is inevitable that binding strength is constant throughout the sheets bound together.

Additionally, in bonding sheets with adhesive toner, it is necessary to determine layout of the binging margin (hereinafter also "bonding range") to which adhesive toner is applied so that adhesive toner does not adversely affect an image according to image data.

BRIEF SUMMARY OF THE INVENTION

In view of the foregoing, one embodiment of the present invention provides an image forming apparatus that includes an image forming unit to form an adhesive toner pattern in a predetermined bonding range of a sheet, a stacking unit to stack multiple sheets one on top of another, and a sheet binding device, a fusing device to fuse the adhesive toner pattern formed on at least one of the multiple sheets to bind the multiple sheets together, and a bonding strength setting unit to determine at least one of multiple variables in accordance with a desired bonding strength. The predetermined bonding range is outside a printable range in which an image according to image data is formed. The multiple variables include a number of color toners used for forming the adhesive toner pattern, a bonding manner, a number of pixels of the adhesive toner pattern, a toner area ratio of the adhesive toner pattern, and a layer thickness of the adhesive toner pattern.

Another embodiment provides a sheet binding device for binding together multiple sheets with adhesive toner that includes a fusing device to fuse an adhesive toner pattern formed in a predetermined bonding range of at least one of the multiple sheets stacked one on top of another, and a printable range setting unit to set a boundary between the bonding range and the printable range to prevent the printable range from overlapping the bonding range.

Yet another embodiment provides a sheet binding device that includes the fusing device and the bonding strength setting unit described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
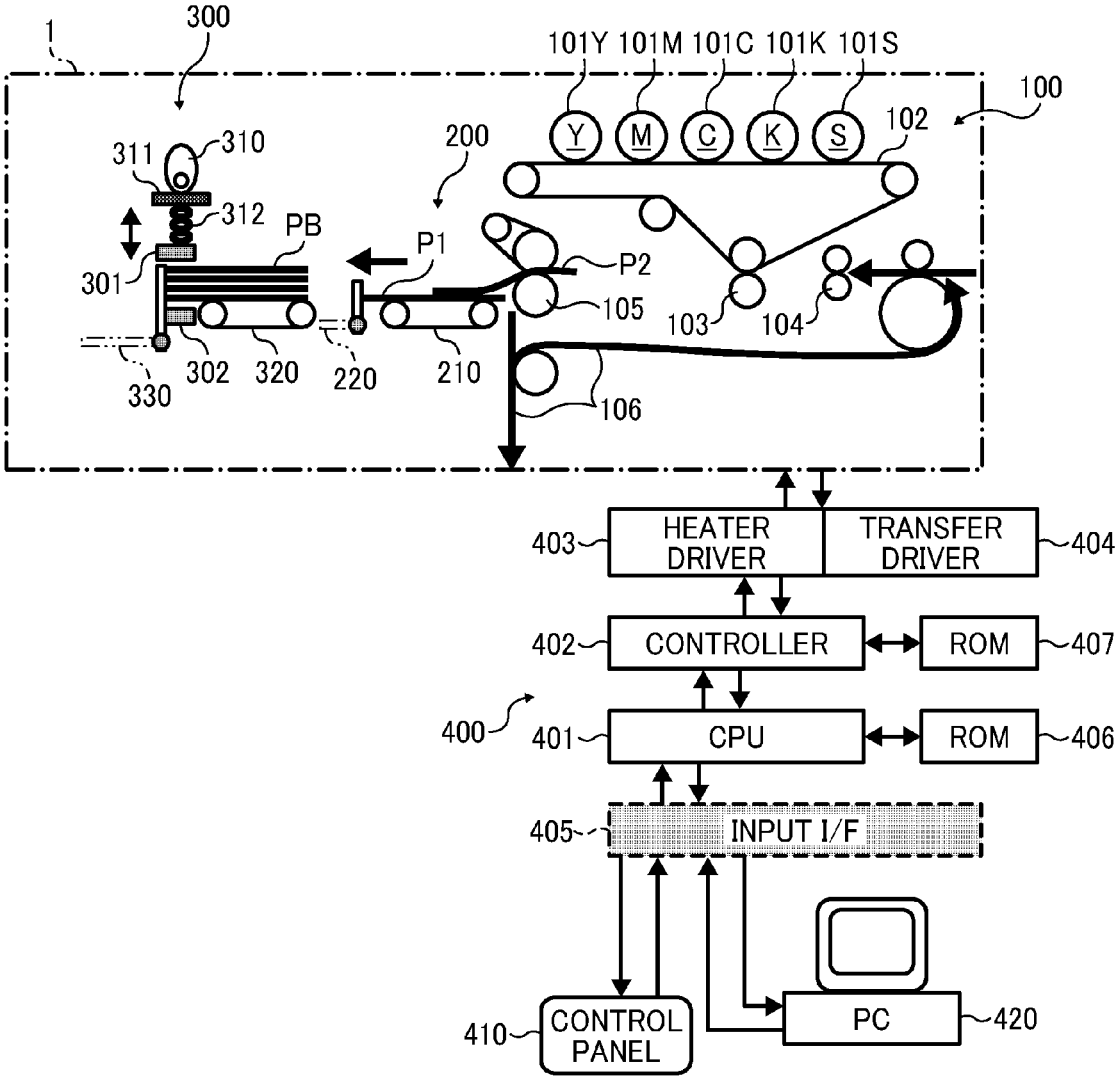
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, K, and S attached to each reference numeral indicate only that components indicated thereby are used for forming yellow, magenta, cyan, black, and special color images, respectively, and hereinafter may be omitted when color discrimination is not necessary. Special color may be while or transparent.

FIG. 1 is a schematic view of an image forming apparatus according to an embodiment of the present invention. Referring to FIG. 1, an image forming apparatus 1 includes an image forming unit 100 to form images on sheets of recording media, an aligning unit 200 to align the sheets, and a binding unit 300 to bond and bind together the aligned sheets.

The image forming unit 100 includes yellow, magenta, cyan, black, and special color stations that include photoreceptor drums 101Y, 101M, 101C, 101K, and 101S, respectively. The image forming unit 100 further includes an intermediate transfer belt 102 disposed in contact with the photoreceptor drums 101Y, 101M, 101C, 101K, and 101S to which toner images are transferred therefrom, a transfer unit 103 to transfer toner images from the intermediate transfer belt 102 onto sheets P (P1 and P2 in FIG. 1) of recording media, a pair of registration rollers 104, a fixing device 105, and a reversal unit 106. The registration rollers 104 forward the sheets P fed from a sheet feeder to the transfer unit 103, timed to coincide with the toner image on the intermediate transfer belt 102, after which the fixing device 105 fixes the toner image on the sheet P with head and pressure. The reversal unit 106 turns the sheet P upside down when a toner image is formed on also the backside of the sheet P. The image forming unit 100 employs a known electrophotographic method. It is to be noted that configurations of the photoreceptor drums 101, components such as a charging device and a development device provided around each photoreceptor drum 101, and an optical writing unit to optically write images on the photoreceptor drums 101 with laser beams are known, and thus descriptions thereof are omitted. In the configuration shown in FIG. 1, the image forming apparatus 1 is a so-called tandem image forming apparatus of intermediate transfer type.

The aligning unit 200 includes a first conveyance belt 210 and a first leading-end aligner 220 that is planar. The aligning unit 200 receives sheets P discharged from the image forming unit 100 one by one. The sheet P is conveyed so that a leading end thereof contacts the first leading-end aligner 220. The sheets P are stacked one on top of another and aligned in a sheet conveyance direction, thus forming a bundle of aligned sheets (hereinafter "sheet bundle PB or bundle of stacked sheets PB"). It is to be noted that the sheets P are aligned also in a sheet width direction perpendicular to the sheet conveyance direction. The first conveyance belt 210 conveys the bundle of stacked sheets PB at a time to the binding unit 300. The first conveyance belt 210 is looped around a driving pulley and a driven pulley and is driven by a driving motor.

The binding unit 300 includes heaters 301 and 302 disposed vertically across a sheet conveyance path, a second conveyance belt 320 to convey the bundle of stacked sheets PB to a position facing the heaters 301 and 302 (i.e., a heated position), a second leading-end aligner 330 to align a leading end of the bundle of stacked sheets PB and keeps the bundle of stacked sheets PB at the heated position, an eccentric cam 310 to ascend or descend the heater 301, and a plate 311 disposed in contact with the eccentric cam 310. The second leading-end aligner 330 is planar. The plate 311 ascends or descends as the eccentric cam 310 rotates. A pressure spring 312 is provided between the heater 301 and the plate 311 to exert a pressing force of predetermined or given degree. An upper end of the pressure spring 312 is attached to a lower surface of the plate 311.

The eccentric cam 310 is rotated by a driving motor and a decelerator for the driving motor. A cam surface of the eccentric cam 310 is in contact with an upper surface of the plate 311 whose lower surface is connected to the pressure spring 312. Accordingly, the plate 311 can serve as a cam follower that reciprocates vertically as the eccentric cam 310 rotates. The amount of compression of the pressure spring 312 is determined by the rotational angle of the eccentric cam 310, and the heater 301 on the upper side receives a pressing force determined by the amount of compression of the pressure spring 312, that is, the amount of displacement of the plate 311, determined by the compression amount of the pressure spring 312. Therefore, a controller 402 designates the amount of rotation of the driving motor for the eccentric cam 310 to set the pressing force applied to the heater 301.

Various operations of the image forming apparatus 1 are controlled by a control mechanism 400. The control mechanism 400 includes a central processing unit (CPU) 401 as a main component and further includes the controller 402, a heater driver 403, a transfer driver 404, an input interface 405, a first read-only memory (ROM) 406, and a second ROM 407. A control panel 410 for users to input instructions and a computer 420 such as a personal computer (PC) are connected to the CPU 401 so that they can communicate mutually. The first ROM 406 is connected to the CPU 401, and the second ROM 407 is connected to the controller 402.

It is to be noted that the CPU 401 includes a control unit to interpret commands and to control a control flow of programs, and a computation unit to execute various types of computation. The first ROM 406 stores the programs, and commands (a numerical value or series of numerical values) to be executed are retrieved from the first ROM 406 in which the programs are stored to execute the program.

Figure 2:
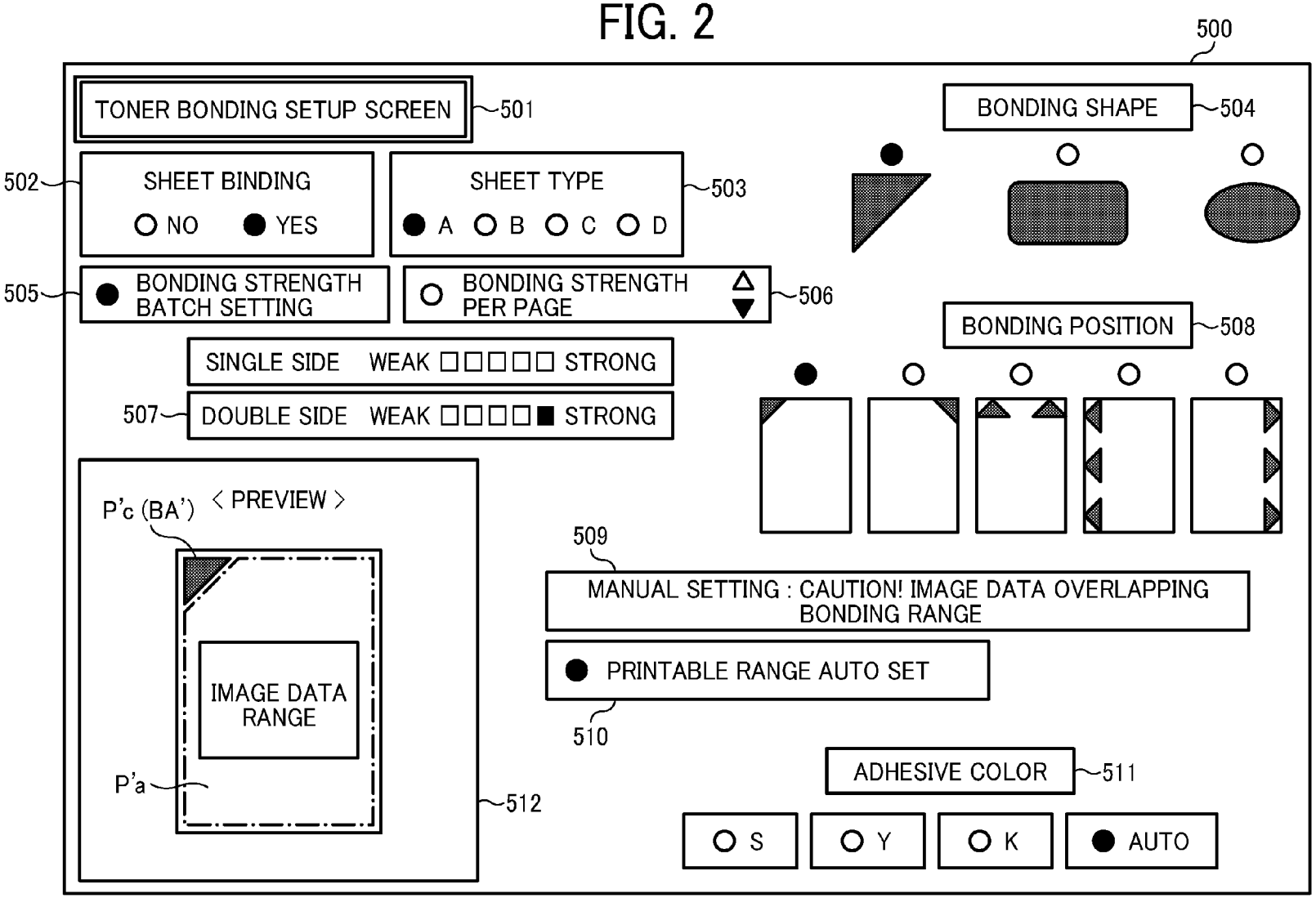
FIG. 2 illustrates a configuration of a setup screen provided on a control panel or in a property portion of a printer driver of a computer.
Figure 3:
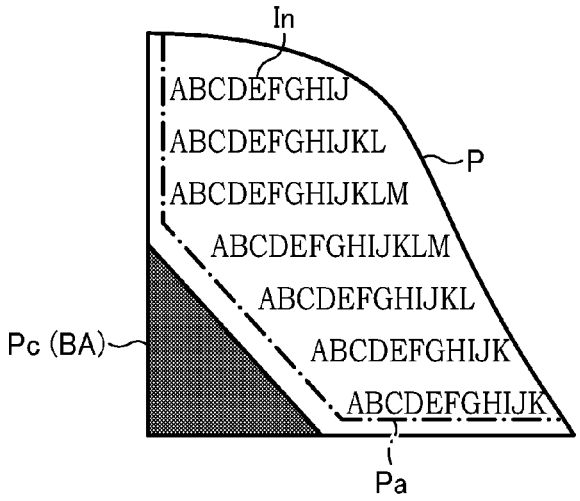
FIG. 3 illustrates the relation between a printable range and an adhesive toner pattern.

FIG. 2 illustrates a configuration of a setup screen 500 provided on the control panel 410 or in a property portion of a printer driver of the PC 420. FIG. 3 illustrates the relation between a printable range Pa and an adhesive toner pattern.

In the present embodiment, sheets P are bound together using adhesive toner. Referring to FIG. 3, an adhesive toner pattern Pc is formed in a predetermined bonding range BA of the sheet P, outside the printable range Pa where image data In is printed. Heat for fusing adhesive toner can diffuse in a surface direction as well as in the direction of depth of the sheets P. Therefore, it is possible that the adhesive toner adheres to an unintended area such as the printable range Pa, degrading image quality. This is a phenomenon generally called "blocking of toner". Additionally, if blocking of toner occurs in an area adjacent to, for example, at 1 mm or shorter from, an image data area, resolution of an output image is degraded, resulting in substandard images.

This phenomenon is described in further detail below with reference to FIG. 4.

Figure 4A:
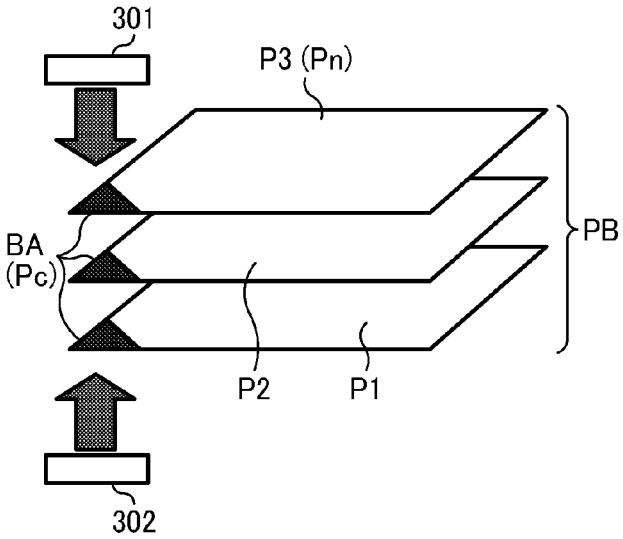
FIGS. 4A and 4B illustrate adverse effects caused by blocking of aggregated toner.

As shown in FIG. 4A, for example, when three sheets P1, P2, and P3 are bound together into a sheet bundle PB using adhesive toner, the adhesive toner pattern Pc is formed in an adhesive range (bonding area) BA at a given corner of each of the sheets P1, P2, and P3. For example, the bonding position may be at an upper left portion of a sheet placed lengthwise (lower left of the sheets P in FIG. 4A). The sheet P on the top (sheet P3 in FIG. 4A) is also referred to as a top sheet (upper sheet) Pn. The sheets P1, P2, and P3 are stacked one on top of the other and then heated by the heater 301 from above the sheet P1, or pressed and heated by the heaters 301 and 302 from above the sheet P3 and from beneath the sheet P1, thereby fusing the adhesive toner patterns Pc.

Figure 4B:
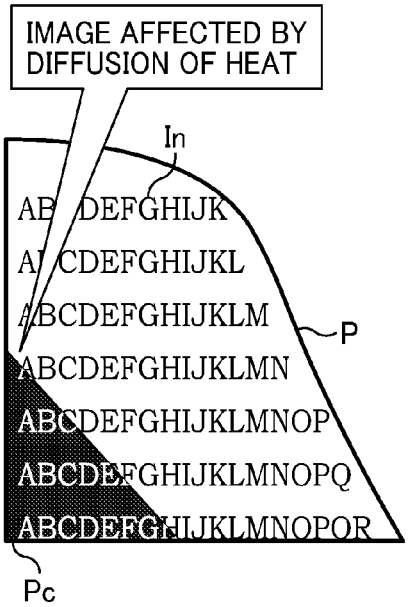

Although the heater 301, or the heaters 301 and 302 contact only an area that is substantially the same as the bonding range BA in which the adhesive toner pattern Pc is formed, heat (temperature multiplied by time) applied to the sheets P tends to diffuse in the surface direction while permeating in the direction of thickness of the sheets P. Consequently, as shown in FIG. 4B, it is possible that image data In (letters or graphics) of one of the sheets P can be transferred to another sheet P, or multiple sheets are bonded together at unintended positions.

If such undesired blocking occurs and the adhesive toner pattern Pc overlaps the image data In printed on the sheet P, toner representing the image data (outlined letters in FIG. 4B) and adhesive toner in the bonding range BA (black area in FIG. 4B) are bonded together, thus making the outlined letters unreadable. When the bonded portions are separated, the image data In of the bonded portions are disturbed. Moreover, the sheets P may be damaged.

In view of the foregoing, when the sheets are bonded together using adhesive toner, the printable range Pa indicated by broken lines shown in FIG. 3 is set. The image according to the image data In is formed inside the printable range Pa, and the bonding range BA is disposed outside the printable range Pa. The image data In can be arranged inside the printable range Pa using the setup screen 500 shown in FIG. 2. In the present embodiment, the setup screen 500 is given a "TONER BONDING SETUP SCREEN" tag 501 to indicate the purpose of this screen.

The setup screen 500 includes a "SHEET BINDING" field 502, a "SHEET TYPE" selection field 503, a "BONDING SHAPE" selection field 504, a "BONDING STRENGTH BATCH SETTING" button 505, a "BONDING STRENGTH PER PAGE" button 506, a field 507 for setting a bonding manner and bonding strength, a "BONDING POSITION" field 508, a "MANUAL SETTING" field 509 for setting the printable range Pa, an "AUTO" button 510 for setting the printable range Pa automatically, and an "ADHESIVE COLOR" selection button 511. In the configuration shown in FIG. 2, either single-side bonding or double-side bonding can be selected as the bonding manner. As a bonding position option, the user may select bonding at multiple positions, and the bonding positions are not limited to a given corner of the sheet as shown in FIG. 2.

A state according to the binding setup is shown in a "PREVIEW" field 512. For example, the "PREVIEW" field 512 illustrates a plan view of the sheet P including a virtual adhesive toner pattern P'c and a virtual printable range P' a to present the state according to selected binding conditions to the user.

When the controller 402 receives a command from the control panel 410 or the printer driver of the PC 420 to bind sheets with adhesive toner, the "PREVIEW" field 512 shows the image data In together with the adhesive toner pattern Pc according to the binding conditions or binding-related variables (bonding strength, bonding shape, bonding position, color of adhesive toner, and the like) thus selected using the setup screen 500 so that the user can check the selected state. If the image data In overlaps the adhesive toner pattern Pc, a caution "IMAGE DATA OVERLAPPING BONDING RANGE" appears in the "MANUAL SETTING" field 509 to report that sheet binding is not feasible to the user. In response to this caution, the user can change the layout or instruct the apparatus to adjust the layout automatically.

More specifically, when one of multiple options is selected in each of the "BONDING SHAPE" selection field 504 and the "BONDING POSITION" field 508, the boundary of the printable range Pa is indicated in the "PREVIEW" field 512 shown in FIG. 2, for example, with broken lines or color discrimination. The bonding shape and bonding position are synchronous, and a preferable combination therebetween is suggested. Thus, the area that does not receive adverse effects of binding or bonding position is enclosed in the area for image data In. The boundary between the printable range Pa and the adhesive toner pattern Pc is determined to prevent adverse effects on the image data or bonding in the printable range Pa caused by the heat diffusing in the thickness direction as well as the surface direction. The printable range Pa shown in FIG. 3 is determined in view of the portion of the image data In thermally affected in FIG. 4B.

Accordingly, the user can input data while checking the "PREVIEW" field 512. Alternatively, after input of data is completed, the bonding shape and the bonding position may be selected from the setup screen 500. Then, the layout of the image data In can be changed automatically to a suitable layout not to cause blocking.

The binding setup and image layout described above can be set according to the image data of the first page of the sheet bundle PB, and the setup is reflected to the remaining pages.

Figure 5A:
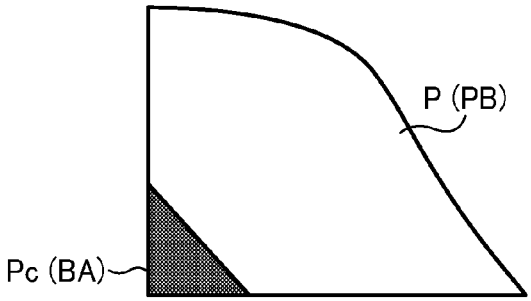
FIGS. 5A and 5B illustrate positions where the adhesive toner patterns are formed.
Figure 5B:
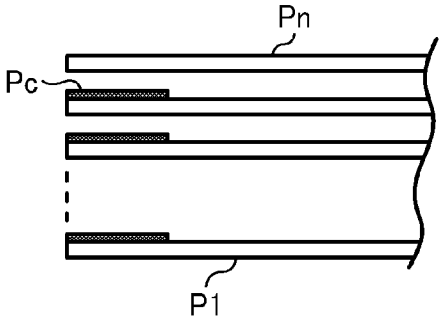

FIGS. 5A and 5B illustrate an ordinal sheet binding using toner, and the adhesive toner pattern Pc is formed one side of the sheet P. The bonding position may be a given corner of the sheet P.

Figure 6:
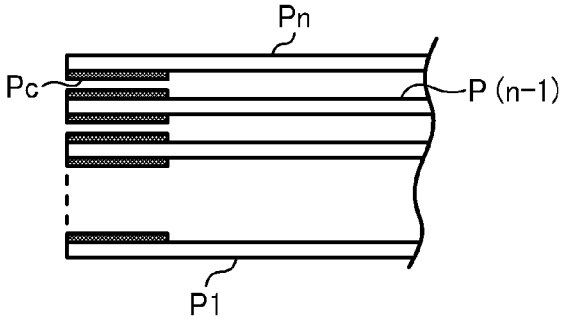
FIG. 6 illustrates positions where the adhesive toner patterns are formed for an increased bonding force.

As shown in FIG. 6, to increase bonding strength, the adhesive toner patterns Pc can be formed on opposing surfaces of adjacent sheets P superimposed one on the other, and bonded together with heat and pressure. Adhesion of toner to the sheet P is strong due to anchor effect of printing performed before sheet binding operation. Additionally, while the superimposed adhesive toner patterns Pc are pressed and heated, wax in toner is fused and fixed, and bonding effects are increased between them. Thus, bonding strength can increase.

Specifically, in the case shown in FIG. 6, except the bottom sheet P1 and the top sheet Pn, similar adhesive toner patterns Pc are formed on both sides of the sheets P at the position to overlap each other and bonded together. It is to be noted that the adhesive toner pattern Pc is not formed on the front side of the sheet Pn and the back side of the sheet P1. To form the adhesive toner patterns Pc on both sides of the sheet P, the sheet P is turned upside down in the reversal unit 106 shown in FIG. 1 after the adhesive toner pattern Pc and the image according to the image data In are formed on the front side of the sheet P, and then the adhesive toner pattern Pc is formed on the back side of the sheet P. Alternatively, in duplex printing, the adhesive toner patterns Pc can be formed simultaneously with the images according to the image data In.

Figure 7:
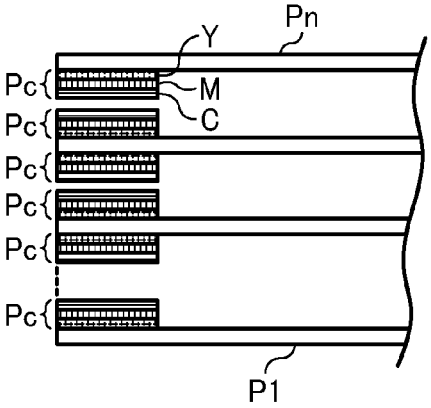
FIG. 7 illustrates adhesive toner patterns and positions thereof for a bonding force greater than that attained in FIG. 6.

Further, in the configuration shown in FIG. 7, the adhesive toner pattern Pc consists of multiple layers, for example, three layers, formed by different color toners (yellow, magenta, and cyan toners in FIG. 7). In this case, the number of the layers can be doubled (six layers in FIG. 7) when the opposing adhesive toner patterns Pc are superimposed. This configuration can increase the strength of adhesion and is effective particularly in bonding sheets such as fiber sheets having surface irregularities. Formation of adhesive toner patterns Pc consisting of multiple layers can be selected using the control panel 410 or the printer driver of the computer 420 similarly. Also in the case of adhesive toner patterns Pc consisting of multiple layers, duplex printing using the reversal unit 106 can be used.

Figure 8:
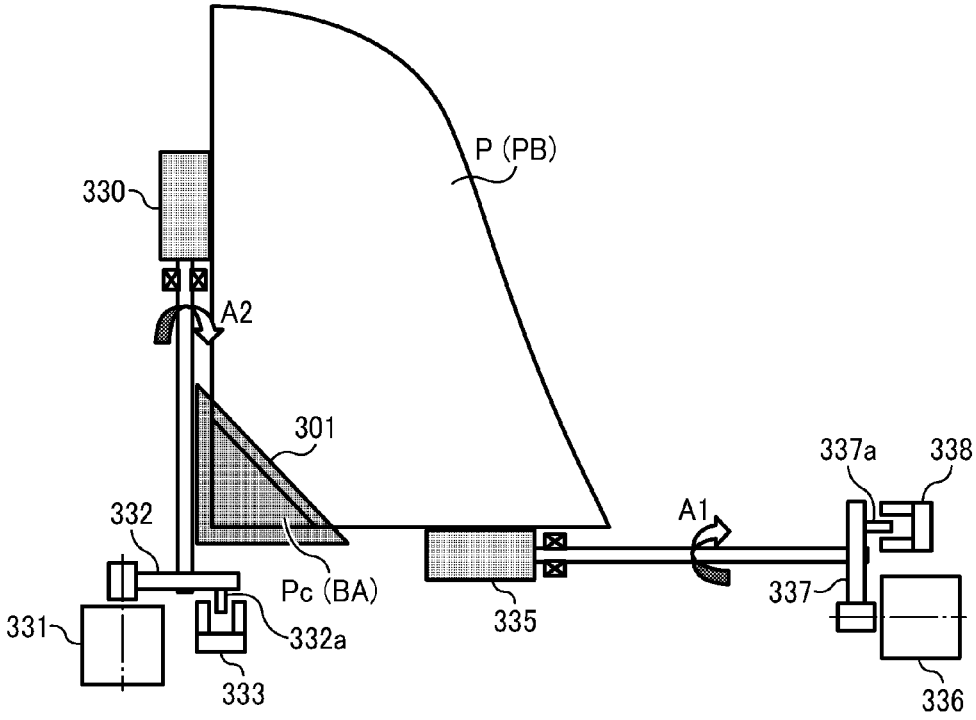
FIG. 8 is an enlarged plan view of a binding unit.

FIG. 8 is an enlarged plan view of the binding unit 300.

The binding unit 300 includes a leading-end regulation unit and a side regulation unit. The leading-end regulation unit includes the second leading-end aligner 330, a driving motor 331 for driving the second leading-end aligner 330, a decelerator 332 that can be a gear mechanism, and a position detector 333 to detect the rotational position of the second leading-end aligner 330. The side regulation unit includes a planar side aligner 335, a driving motor 336 for driving the side aligner 335, a decelerator 337, and a position detector 338 to detect the rotational position of the side aligner 335. As shown in FIG. 8, the second leading-end aligner 330 regulates the leading end of the sheet bundle PB in the sheet conveyance direction, and the side aligner 335 regulates the position of the sheet bundle PB in the sheet width direction, perpendicular to the sheet conveyance direction. The second leading-end aligner 330 and the side aligner 335 rotate or pivot, driven by the driving motor 331 and the driving motor 336 via gears of the decelerators 332 and 337, respectively. The position detectors 333 and 338 detect feelers 332*a* and 337*a* provided to the gears on the driven side, respectively. According to detection signals output therefrom, the CPU 401 recognizes the rotational positions of the second leading-end aligner 330 and the side aligner 335. The controller 402 reflects the detected rotational positions in controlling rotation and stop position of the driving motors 331 and 336. Thus, the positions can be controlled accurately.

The second leading-end aligner 330 and the side aligner 335 align the bundle of stacked sheets PB on the leading side and the lateral side and prevent or reduce positional deviation of the bundle of stacked sheets PB being pressed by the heaters 301 and 302. The multiple sheets P to be bound into a single bundle are transported at a time from the aligning unit 200 by the first conveyance belt 210 onto the second conveyance belt 320 of the binding unit 300. At that time, the second leading-end aligner 330 and the side aligner 335 are rotated to the respective aligning positions. Then, the second leading-end aligner 330 and the side aligner 335 align the bundle of stacked sheets PB at the bonding position. Then, the eccentric cam 310 descends the upper heater 301, which is disposed corresponding to the bonding position, thus applying a predetermined pressure to the bonding range BA of the stacked sheets PB where the adhesive toner pattern Pc is formed. Simultaneously, the heaters 301 and 302 are turned on. Receiving power, the heaters 301 and 302 generate heat, and the adhesive toner patterns Pc are heated under optimal heating conditions. Then, the adhesive toner patterns Pc are fused, and the stacked sheets PB are bonded together into a sheet bundle.

It is to be noted that the predetermined pressure applied by the upper heater 301 is determined by the amount of compression of the pressure spring 312 (displacement amount of the plate 311), which is determined by the rotational angle of the eccentric cam 310. Therefore, the controller 402 designates the amount of rotation of the driving motor for the eccentric cam 310 to attain the predetermined strength of pressing force.

After the sheets are bonded by the heaters 301 and 302, the driving motors 331 and 336 rotate to release the second leading-end aligner 330 and the side aligner 335 from the aligning positions, and the sheet bundle PB is transported downstream from the second leading-end aligner 330 to a stacker or the like.

It is to be noted that, if adhesive toner is applied to the outer side of each of the top sheet Pn and the bottom sheet P1 that contacts a surface of the heater 301 or 302, the toner is burnt, creating a scorch mark. Consequently, the sheet P can be smirched, or the toner adhering to the heater 301 or 302 can impair the contact in heating. Therefore, as shown in FIGS. 5B, 6, and 7, the adhesive toner pattern Pc is not formed in such portions so that the side of the sheet P facing the heater 301 or 302 can contact the heater 301 or 302 directly.

Therefore, according to the number of sheets bonded together, the controller 402 designates formation of the adhesive toner pattern Pc automatically so that the adhesive toner pattern Pc is not formed on the front side of the first sheet P1 and the back side of the last sheet Pn.

The strength of toner bonding and the amount of adhesive toner are described below.

In the case of thin sheets (for example, 30 g/m$^2$ to 40 g/m$^2$), or temporary bonding with a relatively small adhesion force, the amount of adhesive toner required can be smaller. Accordingly, the amount corresponding to single color application can be sufficient as the amount of adhesive toner for maximum adhesion force. Thus, one of the multiple colors is used.

By contrast, when sheet thickness is not small, for example, standard sheets (60 g/m$^2$) or thicker sheets, and the number of sheets area large, for example, 50 sheets, are bound together, the required bonding strength can increase significantly. In such cases, multilayered adhesive toner is necessary to fill in portions consisting of fillers with adhesive toner, thus securing welding sheets with adhesive toner. Accordingly, multiple color toners are used in combination. For example, three adhesive toner patterns PcY, PcM, and PcC, or four adhesive toner patterns PcY, PcM, PcC, and PcK superimposed one on another are transferred onto the sheet P to form a thick adhesive toner layer. Additionally, to increase bonding strength further, the adhesive toner pattern Pc may be formed also on the back side of the sheet P. The thickness of the adhesive toner layer can be doubled when the adhesive toner patterns Pc on the adjacent sheets P are bonded together.

In view of the foregoing, in the present embodiment, the selection buttons 505 and 506 for selecting bonding strength, and the field 507 for selecting bonding strength as well as bonding manner (single-side bonding or double-side bonding) are provided on the setup screen 500 of the control panel 410 as shown in FIG. 2. The user can decide bonding strength depending on sheet type. The user can instruct the image forming apparatus 1 whether the adhesive toner pattern Pc is formed on only one side or both sides of sheets P and further designate bonding strength. In FIG. 2, the user instructs the image forming apparatus 1 to form the adhesive toner patterns Pc on both sides of sheets P, and sets the bonding strength to the maximum. The CPU 401 recognizes values input in the field 507 and issues commands to the controller 402 to control the drivers of the related components. Then, the adhesive toner patterns Pc are formed on the photoreceptor drums 101 and transferred onto the sheet P.

Further, regardless of whether sheet type is the same or different in multiple sheets P bonded together, the multiple sheets P may be bonded with different bonding strengths. For example, the sheet bundle PB can include pages bonded together with a single color adhesive toner pattern Pc and pages bonded together with multicolor adhesive toner pattern Pc. When metal staples are used, it is difficult to change binding strength (bonding strength) in the same sheet bundle PB. Adjustment of bonding strength is difficult also in cases where glue is used.

By contrast, in the present embodiment, bonding strength can be selected in accordance with at least one of sheet type, the quantity of sheets, purpose of use, and the like via the control panel 410 or the computer 420. Heating conditions can be stored as a table preliminarily in the first ROM 406. The CPU 401 can retrieve and select an electrical current value for heating and heater activation time from the table. Based on the selected electrical current value and heater activation time, the heater driver 403 is controlled automatically, and thus proper sheet binding can be performed.

Moreover, to adjust toner adhesion force more delicately, the number of pixels of the adhesive toner pattern Pc may be varied. The bonding strength can be changed linearly according to the number of pixels. Specifically, the number of pixels of the adhesive toner pattern Pc can be varied according to required bonding strength for each page.

Figure 9A:
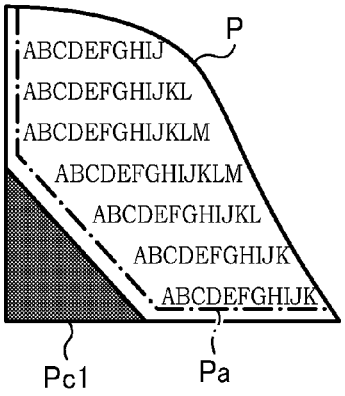
FIGS. 9A, 9B, and 9C illustrate adhesive toner patterns different in image area ratio.
Figure 9B:
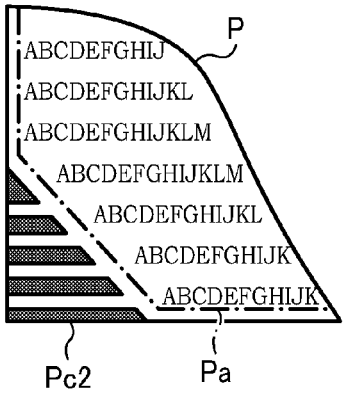
Figure 9C:
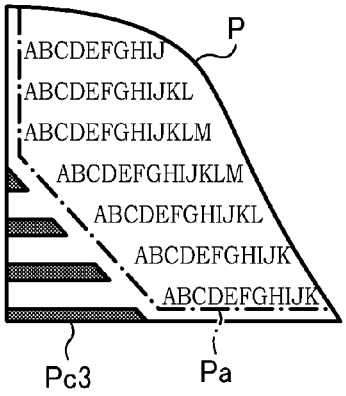

FIGS. 9A, 9B, and 9C illustrate adhesive toner patterns Pc1, Pc2, and Pc3 different in image area ratio or toner area ratio.

The relation between peeling intensity and toner area ratio was experimentally measured. Specifically, the adhesive toner patterns Pc1, Pc2, and Pc3, shown in FIGS. 9A, 9B, and 9C, different in toner area ratio were formed on the sheets P, superimposed, heated, and fixed. The relative peeling intensities of the adhesive toner patterns Pc1, Pc2, and Pc3 were stronger, mediate, and weaker, respectively.

Roughly speaking, the adhesive toner pattern Pc1 is a solid image having an image area ratio of about 100%, the adhesive toner pattern Pc2 has an image area ratio from 50% to 100%, and the adhesive toner pattern Pc3 has an image area ratio from 0% to 50%. Thus, the toner area ratio is a parameter. In terms of relative image area ratios, the adhesive toner pattern Pc1, Pc2, and Pc3 satisfies Pc1>Pc2>Pc3. It is to be noted that the term "image area ratio" used here means the area ratio of the adhesive toner pattern Pc to the entire bonding range BA designated. Although the bonding strength may be adjusted by changing the size of the bonding range BA (i.e., the area occupied by the adhesive toner pattern Pc), increases in the bonding range BA result in decreases in the image data range Pa, which is not desirable. Therefore, in the present embodiment, the area of the bonding range BA is not assigned as a parameter, and bonding strength is adjusted on the premise of an identical bonding range BA, which is an area occupied by the adhesive toner pattern Pc except the printable range Pa.

As can be known from the above-described results of the peeling strength measurement, adhesion force is weaker when the image area ratio is small and stronger when the image area ratio is great. This is similarly to the number of pixels. Therefore, when bonding strength is adjusted by changes in the number of pixels, changes in image area ratio, or both, and also adjusted by selection of the adhesive toner patterns Pc shown in FIG. 5B, 6, or 7, bonding force of adhesion toner after fused and fixed can be adjusted more delicately within a wider range.

Sheet binding thus capable of delicate bonding strength adjustment can meet a variety of needs. For example, there are cases where a sheet bundle consists of two groups of sheets bonded together: one is handed to a customer and the other is kept by a sales person or service person. Specifically, in the case of contracts, after documents are filled out and signed or sealed, the sheet bundle bonded temporarily can be separated. Then, one of two groups of sheets is given to the customer, and the other is kept by the sales person or service person.

Alternatively, for example, first and second pages of a questionnaire are printed alternately in multiple sets, and all sheets are bonded together temporarily, forming a single sheet bundle. In this method, multiple sets of questionnaires can be output at a time and transported as a single sheet bundle to a site where they are handed out to answerers. Then, the sheet bundle is separated two at a time into multiple sets of questionnaires. For example, each questionnaire includes an instruction page and a fill-in page. After filling out the questionnaire, the answerer can separate the fill-in page from the other page and submit it. The adjacent sheets separated when the questionnaires are handed to respective answerers can be bonded with a relatively weak adhesion, and the instruction page and the fill-in page forming a questionnaire set can be bonded together with a stronger adhesion. Thus, when the bonding strength can be varied per page, a variety of needs regarding sheet binding can be satisfied.

It is to be noted that it may be necessary to select the color of adhesive toner according to the type or purpose of sheets bonded. For example, black should not be used in documents for certain types such as wedding cards, and red should not be used in funeral notices. In such cases, white or transparent toner may be used as the last color of superimposed color toners forming the adhesive toner pattern Pc. In this case, similarly to the description above, the user can designate a single color or multiple colors used for the adhesive toner pattern Pc using the "ADHESIVE COLOR" selection button 511 on the setup screen 500 on the control panel 410 or the property portion of the printer driver of the computer 420.

Additionally, in cases where the top color is white or transparent, to adjust bonding strength by the thickness of adhesive toner layer, more particularly, to increase bonding strength by superimposing multiple colors, it is preferable to use less noticeable colors in combination. Such color combination may be yellow and white toners, yellow and transparent toners, or transparent and white toners. At present, white and transparent color in commercial tandem-type image forming apparatuses are called "special color" relative to black, yellow, magenta, and cyan. In the present embodiment, as shown in FIG. 1, the special color station including the photoreceptor drum 101S is provided as the nth station (extreme downstream in the direction of rotation of the intermediate transfer belt 102) among multiple image forming stations to select the colors of multicolor adhesion toner layer in accordance with the type or purpose of documents bonded. The user can select one or multiple colors via the setup screen 500.

It is to be noted that the heaters 301 and 302 together form a fusing device, the CPU 401 can serve as a bonding strength setting unit as well as a printable range setting unit. Further, each of the "BONDING STRENGTH BATCH SETTING" button 505, the "BONDING STRENGTH PER PAGE" button 506, and the field 507 for single-side bonding or double-side bonding and bonding strength can serve as a bonding strength input unit.

As described above, the present embodiment can attain the following effects.

The sheet binding device according to the above-described embodiment includes the CPU 401 serving as the controller to set at least one of multiple bonding-related variables according to the bonding strength required. The bonding-related variables include the number of pixels, toner area ratio, layer thickness, and color of the adhesive toner pattern Pc; and the page on which the adhesive toner pattern Pc is formed. In the designation of page, whether the adhesive toner pattern Pc is formed on a single side or both sides of sheets can be set. Therefore, bonding strength of sheets can be set one or in combination of the bonding-related variables. To attain a wide adjustment range of bonding strength, the number of pixels, the toner area ratio, or both, of the adhesive toner pattern Pc can be changed.

To increase the thickness of adhesive toner layer, the adhesive toner patterns Pc can be formed on opposing surfaces of adjacent sheets P superimposed one on the other. That is, the adhesive toner patterns Pc can be formed on both sides of the sheets P with the positions thereof aligned with each other. Thus, thickness of adhesive toner layer can be doubled when the sheets P are superimposed one on the other. When the sheets P are heated, fused adhesive toner flows to fillers forming paper and gaps therebetween, and sufficient anchor effects can be attained. Moreover, fusion of toner can result in stronger adhesion force.

In setting pages where the adhesive toner pattern Pc is formed, the controller 402 can automatically set so that the adhesive toner pattern Pc is formed on the back side of the top sheet Pn of the sheets P1 to Pn stacked in the page order, the back side or both sides of the interposed sheets P2 through P(n−1), and the front side of the bottom sheet P1. With this setting, when the stacked sheets P1 through Pn are heated by the heaters 301 and 302, creation of scorch marks on the surfaces thereof can be prevented because there is no fused adhesive toner that adheres to the heaters 301 and 302. Additionally, in heating the subsequent sheet bundle PB, the top sheet Pn, the bottom sheet P1, or both, are not smirched with toner adhering to the surface of the heater 301 or 302.

The thickness of the adhesive toner pattern Pc depends on the thickness of single color toner or multiple color toners applied on the sheet P by the image forming unit 100 including yellow, magenta, cyan, and black image forming stations. Accordingly, variables of the adhesive toner pattern Pc can be designated in image formation setting of the image forming unit 100 at the former stage from the binding unit 300, and formation of the adhesive toner pattern Pc can be controlled by the control unit for image formation. This configuration can obviate the need for a control process dedicated for adhesive toner application.

The number of color toners can be designated per page according to necessary bonding strength. When multiple different color toners are superimposed one on another, the amount of toner forming an adhesive layer can increase. When the sheets P are heated, fused adhesive toner flows to fillers forming paper and gaps therebetween, and sufficient anchor effects can be attained, increasing bonding strength.

The CPU 401 can select, in addition to the page on which adhesive toner is applied, bonding strength on each of the selected pages. This configuration enables designation of bonding strength with a higher degree of flexibility.

Accordingly, not only a bonding strength throughout the entire sheet bundle PB can be set, but also bonding strength can be designated on each page. Since bonding strength can be set per page, the sheets P in an identical sheet bundle can be bonded at different bonding strengths, and a single sheet bundle PB may constructed of multiple groups of sheets bonded. Thus, bonding strength can be varied per page according to the purpose of documents to meet a variety of needs.

Since the user can select bonding strength just as he or she desires, sheet binding according to the above-described embodiment can adopt to various types of sheet binding.

Although the bonding range serving as the binding margin is greater than the binding margin in binding sheets using typical metal staples, a boundary between the printable range Pa and the bonding range BA, where the adhesive toner pattern Pc is formed, can be set by the CPU 401 serving as the printable range setting unit in the embodiment described above. Accordingly, the printable range Pa can be set not to overlap with the bonding range BA. Thus, undesired bonding of sheets caused by blocking of aggregated toner can be prevented, and creation of unreadable image portions can be eliminated.

The user can set layout of the printable range Pa and the bonding range BA as well as variables in formation of the adhesive toner pattern Pc using the control panel 410 or from the printer driver of the computer 420. If the adhesive toner pattern Pc overlaps the printable range Pa in which the image data In is printed, the controller 402 can alert the user that the designated layout is improper. Alternatively or additionally, the controller 402 can change the layout automatically to enable binding of sheets with adhesive toner. Additionally, since a preview of the layout according to the selected binding variables is displayed, the user can check whether or not the image range Pa overlaps the bonding range BA before the sheets P are bonded together.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a control unit configured to receive a plurality of variables for bonding a plurality of sheets together, the plurality of variables including at least a number of color toners used for forming an adhesive toner pattern, a bonding manner, a number of pixels of the adhesive toner pattern, a toner area ratio of the adhesive toner pattern, and a layer thickness of the adhesive toner pattern;

an image forming unit configured to form the adhesive toner pattern within a bonding range of each of the plurality of sheets based on at least one of the plurality of variables, the bonding range being outside a printable range in which an image according to image data is formed on each of the plurality of sheets; and a sheet binding device configured to fuse the formed adhesive toner pattern to bind the plurality of sheets together according to a bonding strength, the bonding strength being determined based on the plurality of variables.

2. The image forming apparatus according to claim 1, wherein the image forming unit is configured to form the adhesive toner pattern on one of opposing sides of two adjacent sheets of the plurality of sheets, or on both of the opposing sides of the two adjacent sheets.

3. The image forming apparatus according to claim 1, wherein the image forming unit comprises:

multiple image forming stations to form different color toner images, wherein the layer thickness of the adhesive toner pattern is determined by a layer thickness of either a single color toner or multiple color toners superimposed one on top of another on a given one of the plurality of sheets.

4. The image forming apparatus according to claim 1, wherein the image forming unit comprises: multiple image forming stations to form different color toner images, wherein the adhesive toner pattern is formed of either a single color toner or multiple color toners superimposed one on top on another on a given one of the plurality of sheets.

5. The image forming apparatus according to claim 1, wherein the control unit designates at least one of the number of pixels, the toner area ratio, the layer thickness, and the color of toner of the adhesive toner pattern for each of the plurality of sheets on which the adhesive toner pattern is formed.

6. The image forming apparatus according to claim 1, wherein the control unit is configured to set a boundary between the bonding range and the printable range to prevent the printable range from overlapping the bonding range.

7. The image forming apparatus according to claim 1, wherein the control unit is configured to, receive, as an input, a desired bonding strength, and designate at least one of the plurality of variables according to the desired bonding strength.

8. The image forming apparatus according to claim 7, wherein a user designates either single-side bonding in which the adhesive toner pattern is formed on one of opposing sides of two adjacent sheets of the plurality of sheets, or double-side bonding in which the adhesive toner pattern is formed on both of the opposing sides of the two adjacent sheets.

9. The image forming apparatus according to claim 1, further comprising:

a display configured to indicate a layout of an image formed in the printable range and the adhesive toner pattern formed in the bonding range.

10. The image forming apparatus according to claim 1, further comprising:

a bonding position setting unit configured to set a position of the bonding range.

11. The image forming apparatus according to claim 1, further comprising:

a stacking unit configured to stack the plurality of sheets one on top of another.

12. A sheet binding device for binding together multiple sheets with at least one adhesive toner, the sheet binding device comprising:

a fusing device configured to fuse an adhesive toner pattern formed in a bonding range of a plurality of sheets based on a bonding strength, the boding strength being determined based on a plurality of variables, the plurality of variables including at least a number of color toners used for forming the adhesive toner pattern, a bonding manner, a number of pixels of the adhesive toner pattern, a toner area ratio of the adhesive toner pattern, and a layer thickness of the adhesive toner pattern; and a printable range setting unit configured to set a boundary between the bonding range and a printable range in which an image according to image data is formed to prevent the printable range from overlapping the bonding range.

13. The sheet binding device according to claim 12, further comprising:

a stacking unit configured to stack the plurality of sheets one on top of another.

14. A sheet binding device for binding together multiple sheets with adhesive toners, the sheet binding device comprising:

a control unit configured to receive a plurality of variables for bonding a plurality of sheets together, the plurality of variables including at least a number of color toners used for forming an adhesive toner pattern, a bonding manner, a number of pixels of the adhesive toner pattern, a toner area ratio of the adhesive toner pattern, and a layer thickness of the adhesive toner pattern; and a fusing device configured to fuse the formed adhesive toner pattern to bind the plurality of sheets together according to a bonding strength, the bonding strength being determined based on the plurality of variables.

15. The sheet binding device according to claim 14, further comprising:

a stacking unit configured to stack the plurality of sheets one on top of another.

* * * * *